United States Patent [19]

Weibel

[11] 4,143,509

[45] Mar. 13, 1979

[54] ELECTRONIC TIME-KEEPING SYSTEM WITH ELECTRO-MECHANICALLY-DRIVEN ANALOG DISPLAY AND ELECTRICAL INTEGRAL HOUR RESET FEATURE

[75] Inventor: Gerhard E. Weibel, Deerfield, Ill.

[73] Assignee: Zenith Radio Corporation, Glenview, Ill.

[21] Appl. No.: 743,875

[22] Filed: Nov. 22, 1976

[51] Int. Cl.[2] ..... G04C 3/00; G04B 27/00

[52] U.S. Cl. ..... 58/23 D; 58/23 R; 58/34; 58/35 R; 58/85.5

[58] Field of Search ..... 58/23 R, 23 D, 34–37, 58/85.5

[56] References Cited

U.S. PATENT DOCUMENTS

| | | | |
|---|---|---|---|
| 3,732,685 | 5/1973 | Haydon | 58/35 |
| 3,897,700 | 8/1975 | Haydon | 58/35 R |
| 4,030,283 | 6/1977 | Sauthier et al. | 58/23 R |

*Primary Examiner*—Robert K. Schaefer
*Assistant Examiner*—Leonard W. Pojunas, Jr.
*Attorney, Agent, or Firm*—John H. Coult

[57] ABSTRACT

A time-keeping system of the type having an electromechanically driven, analog-type time display, has a purely electrical integral hour reset feature. The system comprises an analog time display including hour and minute hands driven through a mechanical transmission by a fast-response electromechanical motor. A stable oscillator generates a high frequency time base signal. A chain of frequency dividers coupled to the oscillator develops a time-keeping signal at a minute-related frequency for driving the analog time display in a normal time-keeping mode, and for developing hour reset pulses at a frequency much higher than one pulse per second for driving the analog time display during an integral hour reset operation. Control means coupled to the chain of frequency dividers and responsive to an integral hour reset command causes the analog time display to be rapidly driven by a burst of hour reset pulses whose number equals precisely that number of pulses required to move the hour hand in exact compliance with said command.

9 Claims, 12 Drawing Figures

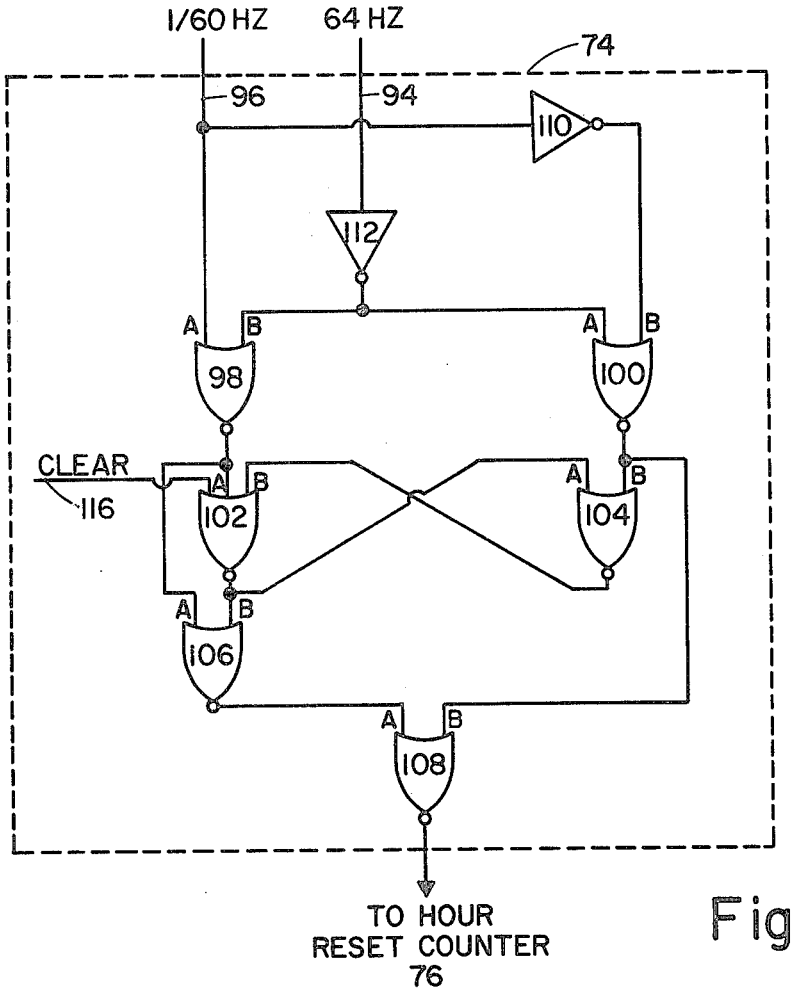
Fig. 3
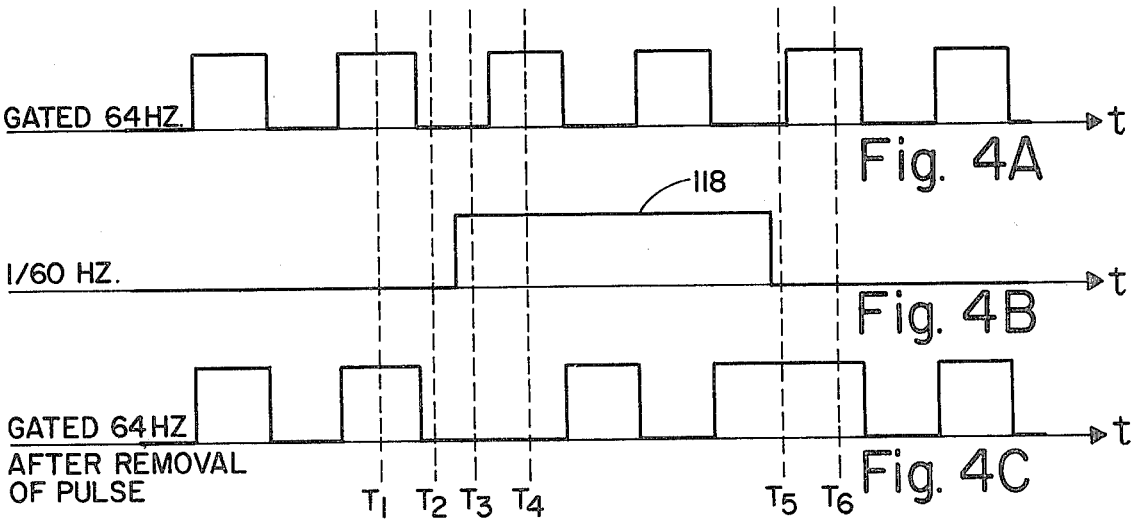
Fig. 4A
Fig. 4B
Fig. 4C

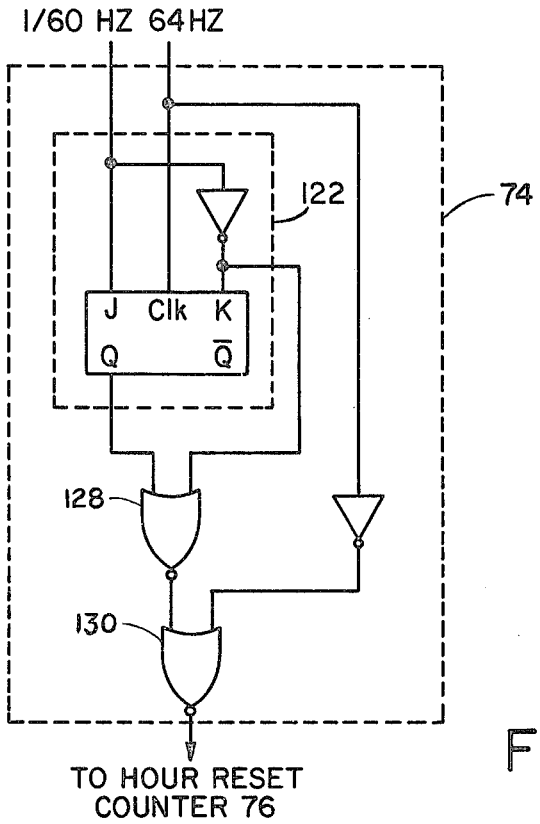
Fig. 5
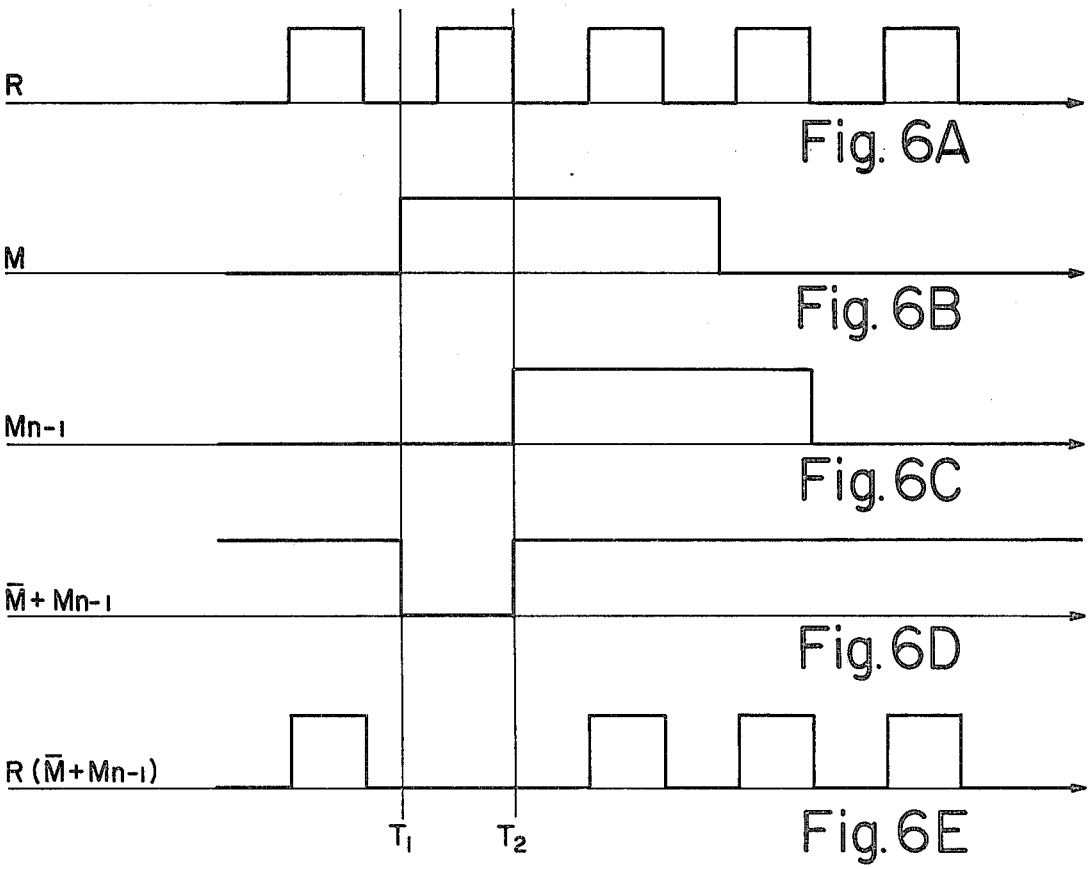

ELECTRONIC TIME-KEEPING SYSTEM WITH ELECTRO-MECHANICALLY-DRIVEN ANALOG DISPLAY AND ELECTRICAL INTEGRAL HOUR RESET FEATURE

BACKGROUND OF THE INVENTION

This invention concerns an electronic time-keeping system of the type which includes a high frequency, high stability oscillator serving as a frequency standard or time base. An electronic frequency divider chain divides the high frequency output from the oscillator and develops one or more pulse trains having a repetition frequency and pulse width suitable for driving an electromechanical time display The display includes an electromechanical motor which drives minute and hour hands through a mechanical transmission. Electronic watches manufactured today of the type described above typically have a quartz crystal oscillator and are commonly termed "quartz mechanical" watches. The term "quartz mechanical" will be used herein in a general sense to mean any electronic watch having a stable oscillator controlling an electromechanical time display.

In particular, this invention is directed to a quartz-mechanical time-keeping system which provides a purely electrical integral hour reset feature.

Quartz-mechanical time-keeping systems typically use purely mechanical hour resetting means — that is to say, a crown, stem, clutch, gear, intermediate gear, etc. The purely mechanical hour reset systems have a number of significant drawbacks. Some are incapable of being set forward and back in integral hours; few are capable of being reset in integral hours with no loss in the time-keeping accuracy of the watch. The purely mechanical reset systems tend to be complex and are apt to be unreliable. Further, they are apt to be cumbersome to operate.

The prior art discloses reset systems in which certain of the necessary resetting functions are achieved electronically. For example, U.S. Pat. No. 3,901,022 discloses a quartz-mechanical watch in which a single mechanical operator is depressed to close a switch and effect a fast-pulse advance of the minute hand. By watching the minute hand advance, the desired number of minutes can be reset by the operator. Hour reset is quite conventional, however. To change the hour setting of the watch, the stem is withdrawn, causing a sliding pinion to engage a setting wheel which can be rotated in the classic manner to effect the desired reset of the hour hand. The U.S. Pat. No. 3,901,022 suggests that the hour reset mechanism can be of a type shown in the art, for example in Swiss Pat. No. 526,804, which is capable of providing integral hour reset. Thus the U.S. Pat. No. 3,901,022 system, while attempting an electronic reset of minutes, relies on the prior art mechanical arrangement for accomplishing hour resetting.

The prior art dicloses other approaches in quartz-mechanical time-keeping systems for resetting hours and minutes by purely electronic means, for example by developing pulses at discrete frequencies or a spectrum of frequencies which can be injected into the motor drive circuit to effect an advance or retard of the display at a rate chosen by the operator. These prior art patents are not known to disclose integral hour advance or retard by purely electronic means. This limits their utility. A collection of prior art showing electronic watches of the type having electromechanical displays and some sort of electronic reset is listed in the table below. The below list also includes miscellaneous prior art patents directed to various electronic watch reset concepts.

| Other Prior Art | |
|---|---|
| 3,707,071-Walton | 3,810,356-Fujita |
| 3,756,013-Bergey et al | British 1,344,393 |
| 3,643,418-Polln et al | 3,786,625-Sauthier |
| 3,792,577-Fujita | 3,812,669-Wiget |
| British 1,344,648 | 3,948,036-Morokawa |
| 3,724,201-Bergey | 3,810,354-Nikaido et al |

OBJECTS OF THE INVENTION

It is an object of this invention to provide a quartz mechanical time-keeping system which has a purely electrical hour reset feature, and which thus obviates the conventional mechanical reset mechanisms in classical watches It is another object to provide such a time-keeping system which makes possible rapid integral hour resetting, with absolutely no loss in accuracy in the time kept by the system.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 3 is a logic diagram showing the contents of a coincidence detector shown in block diagram form in FIG. 2; FIGS. 4A–4C are associated waveforms; and FIG. 5 is a logic diagram of an alternative coincidence detection circuit; FIGS. 6A–6E are associated waveforms.

DESCRIPTION OF THE PREFERRED EMBODIMENTS

Figure 1:
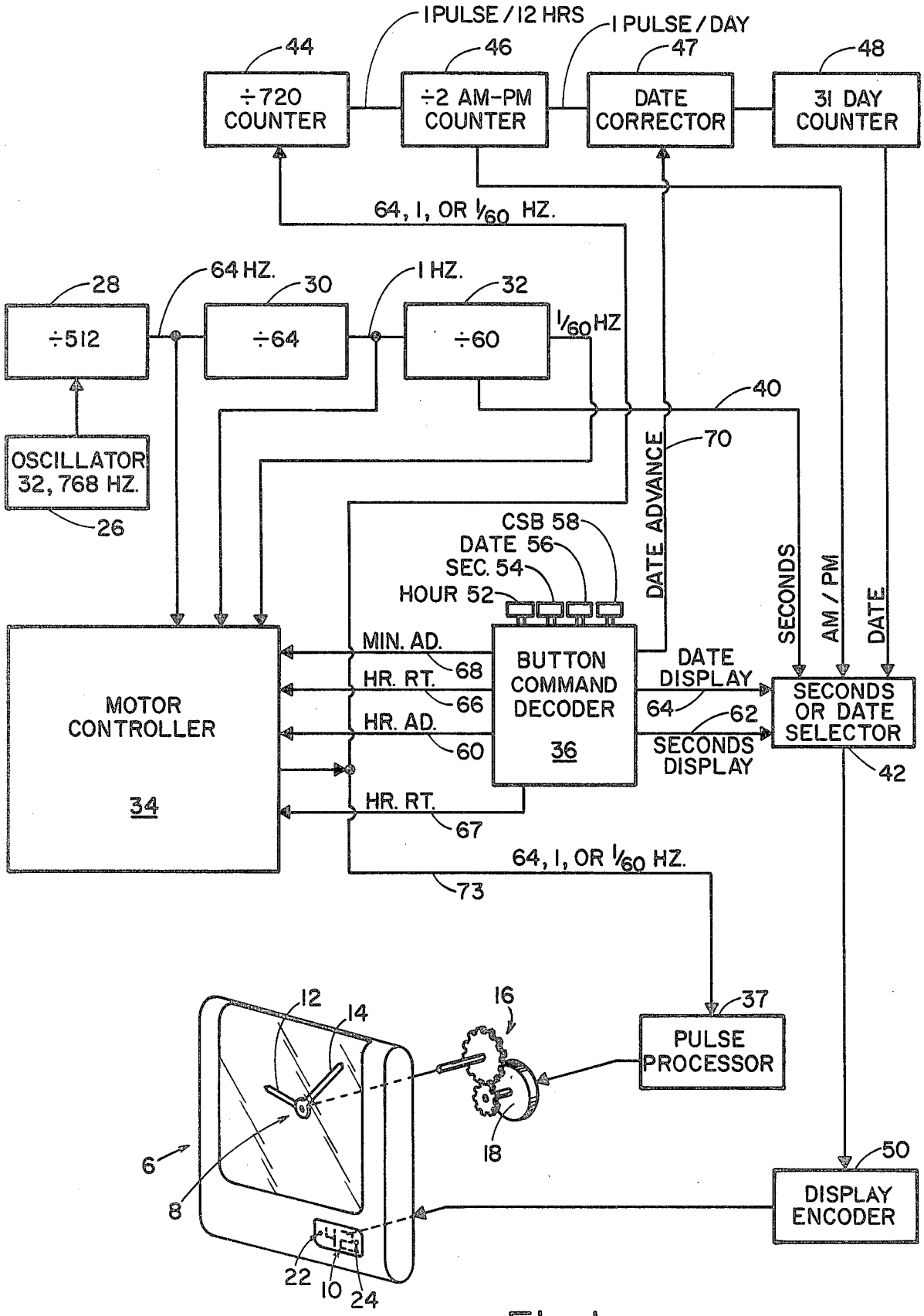
FIG. 1 is a block diagram of a time-keeping system constructed according to the teachings of the present invention.

FIG. 1 illustrates schematically a time piece 6 and a block diagram of a time-keeping system constructed according to this invention for driving an analog display 8 and a separate digital display 10. A time piece with dual displays is claimed in U.S. Pat. Nos. 3,911,665 and 3,945,191, assigned to the assignee of the present application. In the FIG. 1 embodiment, the analog display 8 is illustrated as comprising an hour hand 12 and a minute hand 14 driven through a mechanical transmission 16 by a fast-response electromechanical motor 18, preferably a stepping motor.

The digital display 10 is illustrated as having the capability of displaying two digits of information, and includes a pair of AM-PM dots 22, 24. As will be described in more detail hereinafter, the digital display 10 is capable of selectively displaying either the date or the passing seconds.

It should be understood, of course, that in a real-world realization of the time piece 6, the time-keeping system shown in block diagram form in FIG. 1 would be on an integrated circuit chip and the chip, motor 18 and transmission 16 would be located within the casing of the time piece 6.

An overall description of the FIG. 1 time-keeping system will first be described, followed then by a more detailed description of those aspects of the system which constitute a part of the present invention. The time base for the system is illustrated as taking the form of a stable oscillator, which may be of the common quartz crystal type with associated amplifier, developing a predetermined high frequency — here shown as being at 32,768 hertz. A time base signal developed by the oscillator 26 is fed to a chain of frequency dividers 28, 30, 32 which may be composed, as is well known, of flip-flops and gates.

The chain of frequency dividers develops a number of pulse trains of predetermined frequency which are used to drive the motor 18; others may be developed in the chain for controlling or driving other subcircuits in the system. The signals generated by the FIG. 1 chain of dividers 28, 30, 32 are shown as being at 64 hertz, 1 hertz and 1/60 hertz. As will be described, the 64 hertz pulse train is used to fast-advance the analog display during an integral hour advance or reset according to the present invention. The one hertz signal is used to keep the passing time in seconds (for selective display on the digital display 10) and is also used to advance the analog time display for minute reset purposes. The 1/60 hertz signal is a basic time-keeping signal which drives the analog time display in its normal mode of operation.

It will be evident from a brief inspection of the FIG. 1 time-keeping system, that the oscillator 26 and the time-keeping and reset signals at 64 hertz, 1 hertz and 1/60 hertz feed both the analog time display 8 and the digital display 10. Briefly, the analog time display receives the three time-keeping and reset pulse trains under the control of a motor controller, depicted in block box form at 34, and is responsive to manually given minute-advance, hour-retard and hour-advance commands issued from a button command decoder 36. The motor controller 34 and button command decoder 36 will be described in detail hereinafter.

The time-keeping and reset signals developed by the motor controller 34 are processed in a pulse processor 37 before being fed to the motor 18. In an application wherein the motor is a stepping motor, the pulse processor 37 would contain well-known circuits for shaping and amplifying the pulses before being applied to the motor 18.

A seconds signal is delivered from the divider 32 along the line 40 to a seconds or date selector 42. The selector 42 is a collection of gates which is responsive to date-display and seconds-display commands from the button command decoder 36 and serves to gate through to the digital display 10 the information selected to be displayed.

AM-PM and date signals are developed in a sub-system comprising a divide-by-720 counter 44, a divide-by-2 AM-PM counter 46, a date corrector 47 and a 31-day counter 48. The input to the divide-by-720 counter 44 consists of either a 64 hertz hour reset signal, a 1 hertz minute reset signal or a 1/60 hertz time-keeping signal taken from the output of the motor controller 34. The divide-by-720 counter 44, like all the other counters shown in the time-keeping system, consists merely of a collection of flip-flops or a collection of flip-flops and gates, as is well known. The divide-by-720 counter 44 counts every pulse delivered to the analog time display and, as will become evident hereinafter, acts as a memory to insure that the AM-PM display and the date display remain in perfect accuracy in spite of any minute or hour reset operations which may be performed on the time piece.

The AM-PM counter 46 merely divides the divide-by-720 counter output (1 pulse per 12 hours) to develop a pulse train at one pulse per day. The output from the AM-PM counter 46 is fed through a date corrector 47 which injects date correction pulses when the date is advanced by a date advance operation of the button command decoder 36.

The 31-day counter 48 develops a date signal which is selectively gated through the seconds or date selector 42. A display encoder 50 receives the output from the selector 42 and processes it into a form suitable for driving the digital display 10. The display encoder circuitry may be of conventional design.

At the center of the time-keeping system is the button command decoder 36. The button command decoder consists of a collection of gates capable of being actuated in selected patterns by depression of one or more of a set of four manually operable control buttons — an hour reset button 52, a seconds display button 54, a date display button 56 and a command sequence button (CSB) 58.

The button command decoder 36 has a logical design which causes the following logical operations to be performed. When the hour reset button 52 is depressed, an hour advance signal is developed on line 60 which commands the motor controller 34 to inject sixty additional pulses into the motor 18 at a rate of 64 hertz. When the seconds display button 54 is depressed, a seconds display command is issued along line 62 to the seconds or date selector 42, causing the selector 42 to pass a seconds signal to the digital display 10. When the date display button 56 is depressed, a date display command is issued along line 64 to the seconds or date selector 42 to cause the selector 42 to pass a date information signal to the digital display 10.

When both the hour reset button 52 and date display button 56 are simultaneously depressed, an hour retard command is issued along lines 66, 67 to the motor controller 34 to cause the controller to pass a 64 hertz reset signal to the motor 18. The signal is effective to retard the analog display by a selected integral number of hours. When the command sequence button 58 is depressed, if only briefly, the entire system (except for the oscillator 26) is shut down and all counters are cleared. If the command sequence button 58 is held down for longer than a predetermined interval (for example two seconds), a minute advance command is issued to the motor controller 34 along line 68. This results in minute advance pulses at 1 hertz being passed to the motor 18 to effect an advance of the minute hand at 1 hertz rate for minute reset purposes.

When both the seconds display and date display buttons 54, 56 are simultaneously depressed, a date advance command is issued along line 70 to the date corrector 47. The date advance command consists of a train of 1 hertz pulses which increase the count in the 31 day counter 48 until the desired date appears on the digital display 10.

The contents of the motor controller 34 lies at the heart of this invention and will now be described in detail particularly in connection with the FIG. 2 block diagram. As can be seen, the motor controller 34 is coupled to the chain of frequency dividers 28, 30, 32 and is responsive to integral hour reset commands (either hour-advance or hour-retard) for causing the analog time display to be rapidly driven by a burst of 64 hertz hour reset pulses. The number of reset pulses which are passed to the analog time display equals precisely that number of pulses required to move the hour hand in exact compliance with the said command. For example, if a one hour advance of the analog display 8 is desired, exactly 60 pulses are sent to the motor 18.

Let us now understand how the controller 34 operates when an integral hour advance command is issued from the button command decoder 36 along line 60 by depression of the hour reset button 52. An hour advance command received by the controller 34 operates a frequency selector 72 — here shown in schematic form as a single pole, three-position switch, causing, in effect, the switch to change from its normal 1/60 hertz pulse terminal 82 to terminal 84 which couples it to receive 64 hertz pulses. The motor 18 thus begins to receive 64 hertz reset pulses along line 73.

The 64 hertz reset signal pulses received by the motor 18 are counted by a counting circuit comprising a coincidence detector 74 (to be described later) and a divide-by-60 reset pulse counter 76. The reset pulse counter 76 is activated through a gating circuit 78 by the same hour advance command from the decoder 36. The reset pulse counter 76 counts the 64 hertz reset pulses which are being simultaneously supplied to it and to the motor 18. When 60 pulses have been passed to the analog display, corresponding to the hour hand having been driven through exactly one hour, the reset pulse counter 76 generates an output signal. In the illustrated embodiment this output signal is fed to a frequency selector actuator 80 which causes the frequency selector 72 to switch from the 64 hertz terminal 84 back to the 1/60 hertz terminal 82, and thereby restore the normal mode of operation of the system. Thus the result of the operator having depressed the hour reset button 52 is to cause a burst of 60 reset pulses (at a rate of 64 hertz) to be injected into the motor 18, causing the minute hand 14 to sweep through exactly one hour and stop.

When an hour retard command is issued by the operator, the control means function somewhat differently. As a preface to the ensuing description, it is noted that in the illustrated embodiment, the motor 18 is a motor of the unidirectional type — that is, a motor which operates in one direction only. The relevance of this comment will soon be apparent. An hour retard command along line 66 again causes the motor driving frequency selector 72 to be shifted from its normal position at the 1/60 hertz terminal 82 to the reset pulse terminal 84, with the result that a burst of 64 hertz pulses are delivered to the motor 18. At the same time, the hour retard command, through gating circuit 78, activates the reset pulse counter 76. At every 60th count, the reset pulse counter 76 delivers an output pulse along line 86 to a divide-by-12 hour pulse counter 88. the hour pulse counter 88 has already been loaded, however, to a level corresponding to the number of hours to be retarded. Let us explore that further.

Figure 2:
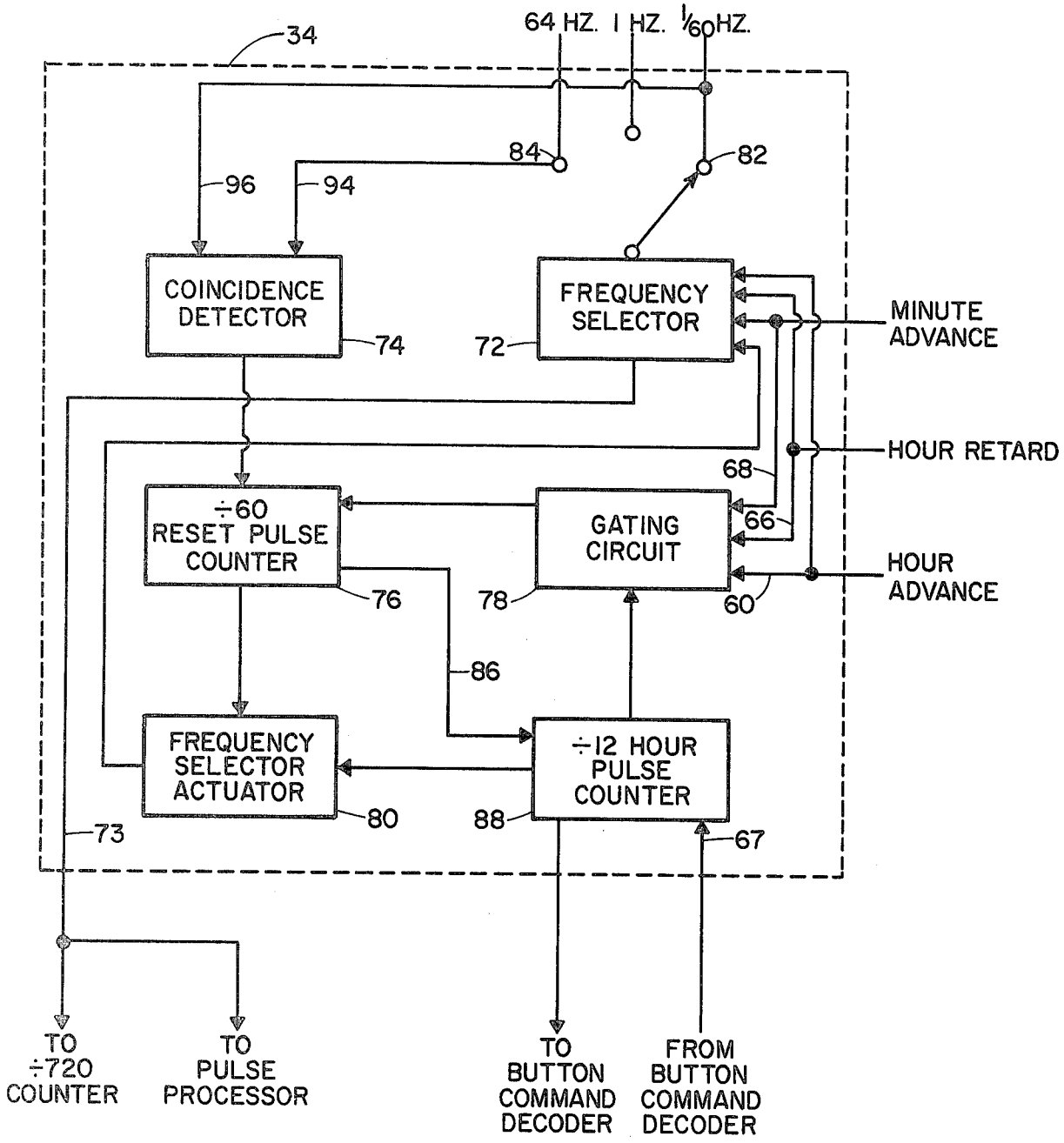
FIG. 2 is a block diagram representing an expansion of one section of the block diagram shown in FIG. 1.

Returning to the FIG. 1 diagram, it is seen that line 67 runs from the output of the button command decoder 36 into the motor controller 34, specifically to the hour pulse counter 88 (see FIG. 2). Each depression of the hour reset button (with the date display button 56 also depressed), results in a pulse being delivered on line 67 to the hour pulse counter. (Note that commands are issued on both lines 66 and 67 when the operator desires to retard the time piece by an integral number of hours.)

Let us assume the number of hours to be retarded is "n." The divide-by-12 hour pulse counter 88 is thus preloaded to a value "n" no greater than 12. As the hour pulse counter 88 receives output pulses from the reset pulse counter 76, its count increases until, at the count of 12, it issues an output to the frequency selector actuator 80, terminating the burst of 64 hertz reset pulses and restoring the normal mode of operation of the system.

By way of further example, it can be seen that if the operator wishes to retard the analog display by exactly 4 hours, he depresses the hour button four times, causing the divide-by-12 hour pulse counter 88 to be preloaded to a count of four. After 480 pulses have been delivered to the motor 18, corresponding to 8 hours advance of the (unidirectional) motor 18 (and thus a retard of 4 hours), the normal mode of operation of the system is restored.

The motor controller 34 also includes pulse adding means for detecting a time coincidence at the analog display 10 between a 1/60 hertz time-keeping pulse and a burst of hour reset pulses, and for arithemetically combining the time-keeping pulse and the reset pulses to preserve the correct time on the display despite said coincidence. In the FIG. 2 diagram, the said pulse adding means is the coincidence detector 74.

The coincidence detector 74 receives reset pulses at 64 hertz on line 94 and normal time-keeping pulses at 1/60 hertz on line 96. In the illustrated embodiment of the invention, the coincidence detector 74 functions to subtract a pulse from the burst of reset pulses fed to the reset pulse counter 76 if a time-keeping pulse is received during an hour reset operation. It can be seen that since the reset pulse counter 76 sees one fewer pulses than the motor 18 upon coincidence of a normal time-keeping pulse and a burst of reset pulses, the motor will receive one extra pulse before the burst of reset pulses is terminated. The time-keeping pulse received during the hour reset operation is thus accounted for, assuring no loss of accuracy in the time-keeping performed by the system.

The logic diagram for the preferred embodiment of the coincidence detector 74 (FIG. 3) will now be described in detail. The coincidence detector 74 comprises NOR gates 98, 100, 102, 104, 106 and 108 and inverters 110 and 112. The ensuing description of the coincidence detector logic circuit will be discussed in connection with the FIGS. 4A, 4B and 4C pulse waveforms. FIG. 4A represents a burst of 64 hertz reset pulses as applied during an hour reset operation to the motor 18 and simultaneously to the coincidence detector 74. FIG. 4B illustrates a 1/60 hertz time-keeping pulse which has been generated during an hour reset operation. That is to say, that there exists a coincidence between a burst of reset pulses and a minute-related time-keeping pulse.

FIG. 4C represents the output of the coincidence detector 92 — a replication of the input 64 hertz reset pulse train, but with one pulse removed. Overlapping the three pulse waveforms (FIGS. 4A–4C) are lines marking times $T_1$–$T_6$ occurring before, during and after an hour reset operation, to be discussed below. The manner in which a pulse is removed from a burst of reset pulses when a time-keeping pulse appears during an hour reset operation will now be described.

Times $T_1$ and $T_2$ are both times when reset pulses are being injected into the motor 18, but no 1/60 hertz time-keeping pulse has occurred. At time $T_1$ both inputs A and B on NOR gate 98 are at logic state 0 ("off") and the output of gate 98 is therefore at logic state 1 ("on"). The input A of NOR gate 100 is at logic state 0, the gate B being at logic state 1. The output of gate 100 is therefore logic 0. The input A of gate 102 is at logic 1; the output thereof is therefore at logic 0. Both inputs to gate 104 are at logic 0 and the output is therefore at logic 1. The input A to gate 106 is at logic 1 and the input B to gate 106 is at logic 0; the output of gate 106 and both inputs to gate 108 are therefore at logic 0 and its output is at logic 1. At time $T_2$, the input reset pulse train (FIG. 4A) has switched to logic 0, but the output pulse train remains in phase with the input pulse train. It is seen that, when the system is operating in this mode, the gate 100 acts as a block and the reset pulses flow through inverter 112 and gates 98, 106, and 108 (a total of four phase inversions), thereby resulting in an output reset pulse train which has the same phase as the input reset pulse train. The output of the circuit is therefore the same 64 hertz reset pulse waveform which is fed into the coincidence detector.

At time $T_3$, however, we see that a time-keeping (clock) pulse, labeled 118 in FIG. 4B, has appeared at a logic state 1. This represents a condition wherein a time-keeping pulse is developed during an integral hour reset operation. At time $T_3$, both inputs to gate 98 are now at logic 1, and input A to gate 100 is at logic 1. The output from both gates 98 and 100, however, remain at logic 0.

Understand what has happened though. Gate 98 now acts as a block, the gate 100 having been opened to pass the next and succeeding reset pulses through to gate 108. The circuit is thus conditioned such that the ensuing portion of the reset pulse train will pass through inverter 112 and gates 100 and 108. The reset pulse train will then be but three times inverted, one less inversion than during times $T_1$ and $T_2$ when no time-keeping pulse 118 was present. The output reset pulse train will thus be the complement of the input reset pulse train. As will be seen, it is than 180° phase delay (together with a later additional 180° phase delay) which produces the desired removal of one pulse from the reset pulse train when a time-keeping pulse appears coincident with a burst of reset pulses.

At time $T_4$ another reset pulse has appeared. With both the time-keeping pulse and the reset pulse train at logic 1, we see that the input B of gate 98 is now at logic 0; the output of gate 98 remains at logic 0. We also see, however, that the input A to gate 100 is now at logic 0, and its output therefore switches to logic 1. The outputs of gates 102 and 104 are now reversed to logic 1 and 0, respectively. The output of gate 106 is switched to logic 0. Gate 108 having a logic 0 on its input A and a logic 1 on its input B, has as its output a logic state 0. The output reset pulse train is indeed now the complement of the input reset pulse train.

The purpose of cross-coupled gates 102 and 104 can now be understood. Without gates 102, 104, at such times as represented by $T_4$ when gate 98 is closed by the presence of a logic 1 on its A input (which receives the time keeping pulse 118), and the gate 100 is opened by the presence of a logic 0 on its B input, it is critical that gate 108 not be closed. If, for example, gate 106 were replaced by a simple inverter to impart the extra phase inversion in the left reset pulse channel, then any time gate 98 was closed, so also would be gate 108. The cross-coupled gates 102, 104 act in concert to assure that when gate 98 is thus closed, gate 108 will nevertheless remain open.

At time $T_5$, the time-keeping pulse 118 has expired and the reset pulse train is at logic 0. Inputs A and B of gate 100 shift to logic 1; the output of gate 100 thus switches to logic 0. The input A of gate 98 shifts to logic 0, but the output of gates 100 and 106 remain at logic 0. We thus see that disappearance of the timing pulse does not immediately change the output of the circuit — it remains at the complement of the input reset pulse train. However, what has happened is that the circuit has been conditioned to switch conduction states from the right channel (gates 100, 108) back to the left channel (gates 98, 106, 108) upon appearance of the next reset pulse.

$T_6$ represents a time at which another reset pulse has appeared. At time $T_6$, the input B of gate 98 and the input A of gate 100 go to logic 0, causing the output of gate 98 to go to logic 1. A logic state 1 on input A of gate 102 causes the latch, comprising gates 102, 104, to switch. The output of gate 102 is thus at logic 0, opening gate 106 for the flow of reset pulses. Unblocking of gates 98 and 106 thus causes the flow of reset pulses to switch back to the path comprising inverter 112 and gates 98, 106 and 108. An even number of inversions of the reset pulse train results in a second 180° phase delay and in the development at the output of the circuit of a train of reset pulses having the same phase as the input pulse train. The two 180° phase delays in the output, one after the appearance and the other after the disappearance of the time-keeping pulse 118, result in the elimination of a single reset pulse from the reset pulse train passing to the motor 18.

In summary then, it can be seen that the circuit operates basically as follows. During an integral hour reset operation, reset pulses flow through the inverter 112 and gates 98, 106, 108 unless a time-keeping pulse appears. Upon appearance of the leading edge of a time-keeping pulse, the circuit is conditioned to switch the path for reset pulses from inverter 112 and gates 98, 106 and 108 to the alternate path comprising inverter 112 and gates 100 and 108. Upon the next appearance of a reset pulse, the path of reset pulses is diverted to the said alternate path, producing one fewer signal inversion. Thus the complement of the reset pulse train is developed at the output of the circuit. Upon expiration of the timing pulse, the circuit is again conditioned to switch the reset pulse conduction path back to inverter 112 and gates 98, 106, 108 upon appearance of the next reset pulse. Looking at the pulse wave forms in FIGS. 4A–4C, it is seen that the net result is two 180° phase delays in the reset pulse trains and the resultant generation of a train of output reset pulses with one pulse omitted.

It can be seen that for the FIG. 3 coincidence detection circuit to operate, the time-keeping pulse must be phased to relative to the reset pulses so as to appear when the reset pulses are at logic state 0 and must be of sufficient length to extend over two positive-going reset pulse transitions.

The FIG. 1 system has been detailed only as to subject matter directly involving the present invention. Many details have been omitted for the sake of clarity of understanding of the present invention. For example, those skilled in the art will understand that such details as the necessary means for clearing and initializing the various counters, means for keeping the AM/PM and date counters correct in spite of integral hour resetting, etc. have been omitted.

The invention is not limited to the particular details of the structure depicted, and other modifications and applications are contemplated. In the disclosed embodiment, the electromechanical motor 18 was described as being a stepping motor of the unidirectional type. Alternatively, in a system wherein a bidirectional motor and motor drive system were employed, the system would be modified such that to retard by an integral number of hours, a burst of reset pulses of the appropriate number would be fed to the motor to drive it backwards through exactly the number of hours by which the analog display was commanded to be retarded. The coincidence detector is an embodiment such as that, would be modified to supply one extra pulse, rather than one fewer pulse in order to assure no loss in time-keeping accuracy of the time piece during an integral hour reset operation. Other systems and circuits for achieving the coincidence detection and other functions described may be devised within the skill of the art. For example, FIG. 5 illustrates an alternative coincidence detector which may be substituted in the box 74 for the FIG. 3 coincidence detector. The FIG. 5 coincidence detector is illustrated as comprising a standard D-type flip-flop 122 having as its inputs the 1/60 hertz time-keeping signal and the 64 hertz reset pulse train. The flip-flop 122 has outputs feeding a NOR gate 128. The output of NOR gate 128 and a second signal representing the complement of (the inverse of) the 64 hertz reset pulse train are fed to a second NOR gate 130. The output of gate 130 is fed to the hour reset counter 76 (see FIG. 2).

If we term the 1/60 hertz time-keeping signal as function M and the 64 hertz reset pulse train as function R, then it is clear that one input to NOR gate 128 is $\overline{M}$. The second input to NOR gate 128 is a signal from the "Q" terminal of flip-flop 122; it will be termed function $M_{n-1}$. The output from NOR gate 128 is a signal taking the form $$\overline{\overline{M} + M_{n-1}}$$

The second input to NOR gate 130 is $\overline{R}$. The output from NOR gate 130 thus takes the form $R(\overline{M} + M_{n-1})$ which is exactly the function desired to effect a removal of one pulse from the reset pulse train when a time-keeping pulse appears during an integral hour reset operation.

FIGS. 6A–6E are waveforms which serve to better explain the operation of the FIG. 5 coincidence detector. FIG. 6A represents the function R — simply a train of 64 hertz reset pulses. FIG. 6B represents the function M, i.e., a 1/60 hertz time-keeping pulse. FIG. 6C represents the function $M_{n-1}$ — a time-keeping pulse delayed by an interval encompassing one reset pulse.

FIG. 6D represents the function $\overline{M} + M_{n-1}$. It is seen that the NOR gate 130 receives as inputs the complement of the FIG. 6A pulse train as well as the complement of the FIG. 6D waveform.

FIG. 6E is a function taking the form $R(\overline{M} + M_{n-1})$. Note the omission of one reset pulse from the input reset pulse train (FIG. 6A). In the FIG. 6A–6E diagrams, time T1 represents the leading edge of a 1/60 hertz time-keeping pulse appearing during an hour reset operation. Time T2 represents the time of occurrence of the trailing edge of a reset pulse. It will be recognized by those skilled in the art that care must be taken to avoid a spiking condition at time T2.

It is intended therefore that the subject matter in the above depiction shall be interpreted as illustrative and not in a limiting sense.

What is claimed is:

1. In an electronic time piece, a time-keeping system having an electromechanically driven, analog-type time display, and having a purely electrical integral hour reset feature, said system comprising:

an analog time display including hour and minute hands driven through a mechanical transmission by a fast-response electromechanical motor;

a stable oscillator generating a high frequency time base signal;

a chain of frequency dividers coupled to said oscillator for developing a time-keeping signal at a minute-related frequency for driving said analog time display in a normal time-keeping mode, and for developing hour reset pulses at a frequency much higher than one pulse per second for driving said analog time display during an integral hour reset operation; and control means including counter means and memory means coupled to said chain of frequency dividers and responsive to an integral hour reset command for causing said analog time display to be rapidly driven by a burst of hour reset pulses whose number equals precisely that number of pulses required to move said hour hand in exact compliance with said command, and then for automatically returning said analog time display to said normal time-keeping mode.

2. In an electronic time piece, a time-keeping system having an electromechanically driven, analog-type time display, and having a purely electrical integral hour reset feature, said system comprising:

an analog time display including hour and minute hands driven through a mechanical transmission by a fast-response electromechanical motor;

a stable oscillator generating a high frequency time base signal;

a chain of frequency dividers coupled to said oscillator for developing a time-keeping signal at a minute-related frequency for driving said analog time display in a normal time-keeping mode, and for developing hour reset pulses at a frequency much higher than one pulse per second for driving said analog time display during an integral hour reset operation; and control means coupled to said chain of frequency dividers and responsive to an hour reset command for causing said analog time display to be rapidly driven by a burst of said hour reset pulses, said control means including a counter for counting the reset pulses applied to said analog time display and for generating an output signal when a number of reset pulses has been counted which corresponds to said hour hand having been driven through exactly one hour.

3. In an electronic time piece, a time-keeping system having n electromechanically driven, analog-type time display, and having a purely electrical integral hour reset feature, said system comprising:

an analog time display including hour and minute hands driven through a mechanical transmission by a fast-response electromechanical motor;

a stable oscillator generating a high frequency time base signal;

a chain of frequency dividers coupled to said oscillator for developing a time-keeping signal at a minute related frequency for driving said analog time display in a normal time-keeping mode, and for developing hour reset pulses at a frequency much higher than one pulse per second for driving said analog time display during an integral hour reset operation;

control means coupled to said chain of frequency dividers and responsive to an hour reset command for causing said analog time display to be rapidly driven by a burst of said hour reset pulses, said control means including a counter for counting the reset pulses applied to said analog time display and further including means for terminating the reset pulses when a number of reset pulses has been counted which corresponds to said hour hand having been driven through exactly one hour.

4. In an electronic time piece, a time-keeping system having an electromechanically driven, analog-type time display, and having a purely electrical integral hour reset feature, said system comprising:

an analog time display including hour and minute hands driven through a mechanical transmission by a fast-response unidirectional electromechanical motor;

a stable oscillator generating a high frequency time base signal;

a chain of frequency dividers coupled to said oscillator for developing a time-keeping signal at a minute-related frequency for driving said analog time display in a normal time-keeping mode, and for developing hour reset pulses at a frequency much higher than one pulse per second for driving said analog time display during an integral hour reset operation; and control means coupled to said chain of frequency dividers and responsive to an n-hour retard command for causing said analog time display to be rapidly driven by a burst of said hour reset pulses, "n" representing a selected integer no greater than twelve, and "n-hour" representing a selected integral number of hours by which the system is to be retarded, said control means including:

a reset pulse counter for counting the reset pulses applied to said analog time display and for generating an output pulse each time a number of reset pulses has been generated which corresponds to said hour hand having been driven through exactly one hour, and a divide-by-12 hour pulse counter coupled to said reset pulse counter for cumulatively receiving and totaling n retard command pulses corresponding to the integral number of hours through which the display is to be retarded and 12-minus-n output pulses from said reset pulse counter, said hour pulse counter, when it has counted to 12, generating an output effective in said control means to terminate said burst of hour reset pulses and to restore said system to its normal time-keeping mode.

5. In an electronic time piece, a time-keeping system having an electromechanically driven, analog-type time display, and having a purely electrical integral hour reset feature, said system comprising:

an analog time display including hour and minute hands driven through a mechanical transmission by a fast-response electromechanical motor;

a stable oscillator generating a high frequency time base signal;

a chain of frequency dividers coupled to said oscillator for developing a time-keeping pulse-type signal at 1/60 Hz for driving said analog time display in a normal time-keeping mode and for developing hour reset pulses at 64 Hz for driving said analog time display during an hour reset operation; and control means coupled to said chain of frequency dividers and responsive to a one hour advance reset command for causing said analog time display to be rapidly driven by a burst of said hour reset pulses, said control means including a counter for counting the reset pulses applied to said analog time display and for terminating the reset pulses when sixty reset pulses have been received, corresponding to a revolution of said hour hand through exactly one hour.

6. In a wrist watch, a time-keeping system having an electromechanically driven, analog-type time display, and having a purely electrical integral hour reset feature, said system comprising:

an analog time display including hour and minute hands driven through a mechanical transmission by a fast-response unidirectional electromechanical motor;

a stable oscillator generating a high frequency time base signal;

a chain of frequency dividers coupled to said oscillator for developing a time-keeping signal at a minute-related frequency for driving said analog time display in a normal time-keeping mode, and for developing hour reset pulses at a frequency much higher than one pulse per second for driving said analog time display during an integral hour reset operation; and control means coupled to said chain of frequency dividers, said control means including:

manual operator means for selectively developing an hour advance command or an n-hour retard command, "n" representing a selected integer no greater than twelve, and "n-hour" representing a selected integral number of hours by which the system is to be retarded, means coupled to said manual operator means and responsive to an n-hour retard command or an hour advance command for causing said analog time display to be rapidly driven by a burst of said hour reset pulses, a reset pulse counter for counting the reset pulses applied to said analog time display and for generating an output hour pulse each time a number of reset pulses has been counted which corresponds to said hour hand having been driven through exactly one hour, a divide-by-twelve hour pulse counter coupled to said reset pulse counter for cumulatively receiving and totaling n retard command pulses corresponding to the integral number of hours through which the display has been commanded to be retarded and twelve-minus-n output pulses from said reset pulse counter, said our pulse counter, when it has counted to twelve, generating an output pulse; and means coupled to said counters for terminating the application of reset pulses to said time display upon receipt of an output pulse from said reset pulse counter when an hour advance command has been given, or upon receipt of an output pulse from said hour pulse counter when an hour retard command has been given.

7. In an electronic time piece, a time-keeping system having an electromechanically driven, analog-type time display, and having a purely electrical integral hour reset feature, said system comprising:

an analog time display including hour and minute hands driven through a mechanical transmission by a fast-response electromechanical motor;

a stable oscillator generating a high frequency time base signal;

a chain of frequency dividers coupled to said oscillator for developing time-keeping pulses at a minute-related frequency for driving said analog time display in a normal time-keeping mode, and for developing hour reset pulses at a frequency much higher than one pulse per second for driving said analog time display during an integral hour reset operation.

control means coupled to said chain of frequency dividers and responsive to an hour reset command for causing said analog time display to be rapidly driven by a burst of said hour reset pulses, said control means including pulse adding means for detecting a time coincidence at said display between a time keeping pulse and a burst of hour reset pulses and for arithmetically combining said time-keeping pulse and reset pulses to preserve the correct time on said display despite said coincidence.

8. In an electronic time piece, a time-keeping system having an electromechanically driven, analog-type time display, and having a purely electrical integral hour reset feature, said system comprising:

an analog time display including hour and minute hands driven through a mechanical transmission by a fast-response unidirectional electromechanical motor;

a stable oscillator generating a high frequency time base signal;

a chain of frequency dividers coupled to said oscillator for developing time-keeping pulses at a minute-related frequency for driving said analog time display in a normal time-keeping mode, and for developing hour reset pulses at a frequency much higher than one pulse per second for driving said analog time display during an integral hour reset operation; and control means coupled to said chain of frequency dividers and responsive to an n-hour retard reset command for causing said analog time display to be rapidly driven by a burst of said hour reset pulses, "n" representing a selected integer no greater than twelve, and "n-hour" representing a selected integral number of hours by which the system is to be retarded, said control means including:

a reset pulse counter for counting the reset pulses applied to said analog time display and for generating an output hour pulse each time a number of reset pulses has been counted which corresponds to said hour hand having been driven through exactly one hour, a divide-by-12 hour pulse counter coupled to said reset pulse counter for cumulatively receiving and totaling n retard command pulses corresponding to the integral number of hours through which the display is to be retarded and twelve-minus-n hour pulses from said reset pulse counter, said hour pulse counter, when it has counted to twelve, generating an output effective in said control means to terminate said burst of hour reset pulses and to restore said system to its normal time-keeping mode, and pulse adding means for detecting a time coincidence at said display between a time-keeping pulse and a burst of hour reset pulses and for adding said time-keeping pulse and reset pulses to preserve the correct time on said display despite said coincidence.

9. In a wrist watch system having an electromechanically driven, analog-type time display, and having a purely electrical integral hour reset feature, said system comprising:

an analog time display including hour and minute hands driven through a mechanical transmission by a fast-response unidirectional stepping motor;

a stable oscillator generating a high frequency time base signal;

a chain of frequency dividers coupled to said oscillator for developing a time-keeping signal at 1/60 Hz for driving said analog time display in a normal time-keeping mode, and for developing hour reset pulses at 64 Hz for driving said analog time display during an integral hour reset operation; and control means coupled to said chain of frequency dividers and including:

manual operator means for selectively developing an hour advance command or an n-hour retard command, "n" representing a selected integer no greater than twelve, and "n-hour" representing a selected integral number of hours by which the system is to be retarded, means coupled to said manual operator means and response to an n-hour retard command or an hour advance command for causing said analog time display to be rapidly driven by a burst of said hour reset pulses, a reset pulse counter for counting the reset pulses applied to said analog time display and for generating an output hour pulse each time sixty reset pulses has been counted, corresponding to said hour hand having been driven through exactly one hour, a divide-by-12 hour pulse counter coupled to said reset pulse counter for cumulatively receiving and totaling n retard command pulses corresponding to the integral number of hours through which the display has been commanded to be retarded, and twelve-minus-n hour pulses from said reset pulse counter, said hour pulse counter, when it has counted to twelve, generating an output pulse, means coupled to said counters for terminating the application of reset pulses to said time display upon receipt of an hour pulse from said reset pulse counter when an hour advance command has been given, or upon receipt of an output pulse from said hour pulse counter when an hour retard command has been given, and pulse adding means for detecting a time coincidence between a time-keeping pulse and a burst of hour reset pulses and for adding said time-keeping pulse and reset pulses to preserve the correct time on said display despite said coincidence.

* * * * *